US005813604A

United States Patent [19]

Frassetti

[11] Patent Number: 5,813,604

[45] Date of Patent: Sep. 29, 1998

[54] PERSONALIZED NAME STRAW

[76] Inventor: Anthony Frassetti, 7 Stonebridge Court, Manalapan, N.J. 07726

[21] Appl. No.: 873,801

[22] Filed: Jun. 12, 1997

Related U.S. Application Data

[63] Continuation-in-part of Ser. No. 529,343, Sep. 18, 1995, abandoned.

[51] Int. Cl.[6] ..... A47G 21/18

[52] U.S. Cl. ..... 239/33; D7/300.2

[58] Field of Search ..... 239/33; 446/71, 446/74; D7/300.2

[56] References Cited

U.S. PATENT DOCUMENTS

| | | | |
|---|---|---|---|
| 3,517,884 | 6/1970 | Horvath | 239/33 |
| 3,780,944 | 12/1973 | Zubalik | 239/33 |
| 4,379,511 | 4/1983 | Del Fabro | 239/33 |
| 5,184,774 | 2/1993 | Lipson | 239/33 |
| 5,201,460 | 4/1993 | Caines | 239/33 |

*Primary Examiner*—Lesley D. Morris
*Attorney, Agent, or Firm*—Charles I. Brodsky

[57] ABSTRACT

A personalized name straw including a plurality of generally tubular components to form a drinking straw of desired configuration, and with one of the components being in the nature of a personalized name having a conduit therein to channel liquids from a first end through to a second end, for the sipping of liquid through the straw. Individual spacers are included between openings of each abutting, adjacent letter of the name to channel the liquid from its first letter, through the individual spacers, and into the last letter of the name in one direction of use, and to channel the liquid from the last letter of the name, through the individual spacers, into the first letter, when used in reverse fashion.

6 Claims, 3 Drawing Sheets

PERSONALIZED NAME STRAW

This application is a Continuation-in-Part application of Ser. No. 08/529,343, filed Sep. 18, 1995, now abandoned.

FIELD OF THE INVENTION

This invention relates to drinking straws and, more particularly, to a drinking straw which would be quite appealable to toddlers and school-age children.

BACKGROUND OF THE INVENTION

As is well known and understood, drinking straws are usually employed by toddlers and school-age children to sip liquid therethrough, and to "blow bubbles" in reverse into the liquid retaining container. As is also well known and understood, drinking straws of this type are available both "bendable" and "fixed", in straight or looping configuration, transparent or solid, and typically of the same overall length—whether to fit within an 8 oz. can, a 12 oz. bottle, a 16 oz. bottle, or a 4, 6 or 8 oz. glass.

As will be appreciated, it would be desirable if a drinking straw could be shaped by the child into their own desired configuration, to fit the size of the liquid retaining container in which it is to be used, and to be further identifiable as belonging to one child of a family, instead of to its sibling brothers or sisters.

SUMMARY OF THE INVENTION

As will become clear from the following description, the drinking straw of the invention is intended to be personalized with the name of the user, with the "name" being one of the individual components which can be put together in forming the drinking straw of a desired, unique configuration. Thus, and as will be seen, a preferred embodiment of the invention includes a plurality of these interchangeable, generally tubular components, individual ones of which being detachably securable together by appropriate coupling means, and with the personalized name having a conduit therein to channel the liquid from a first end thereof to a second end thereof. As will be seen, the interchangeable components include individual ones of straight, loop and right-angle components for shaping the straw into the desired configuration. The personalized name component in this embodiment will further be seen to include a plurality of letters and spacers between them, for channeling liquid from a first letter of the name through the individual spacers into the last letter of the name. In accordance with a preferred construction, furthermore, the interchangeable components are selected of a rigid, plastic composition, individually colored and transparently see-through so as to observe the course of liquid passing through the straw while sipping. In the particular embodiment set forth, three straight components, three loop components and one right-angle component are described, each with their own coupler, to detachably secure with the personalized name component, and of lengths and configurations which can be fitted together by the child in obtaining the shape and configuration of the drinking straw wanted at that time. As will be appreciated by those skilled in the art, in addition, because of the detachable nature in securing the components together, that design can later be altered, where desired, to come up with a different configuration at such later date, if wanted. In such manner, and as will be readily understood, a specific "drinking straw design" is possible, of a nature that would appeal to children of these ages both for "sipping" and for "blowing bubbles".

BRIEF DESCRIPTION OF THE DRAWINGS

These and other features of the present invention will be more clearly understood from a consideration of the following description, taken in connection with the accompanying drawing, in which.

DETAILED DESCRIPTION OF THE DRAWINGS

Figure 1:
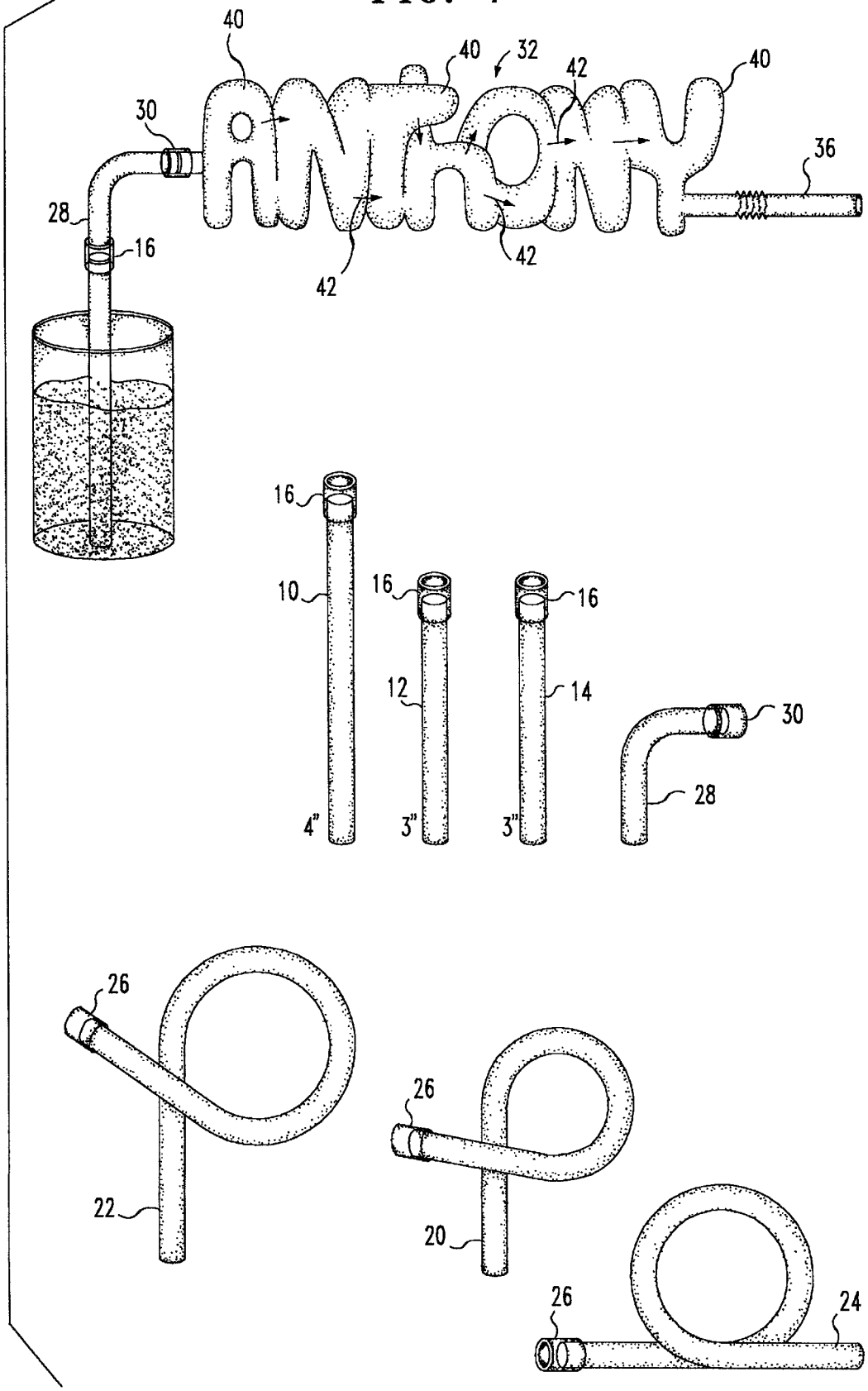
FIG. 1 illustrates a plurality of interchangeable components helpful in an understanding of the personalized name straw of the invention.
Figure 2:
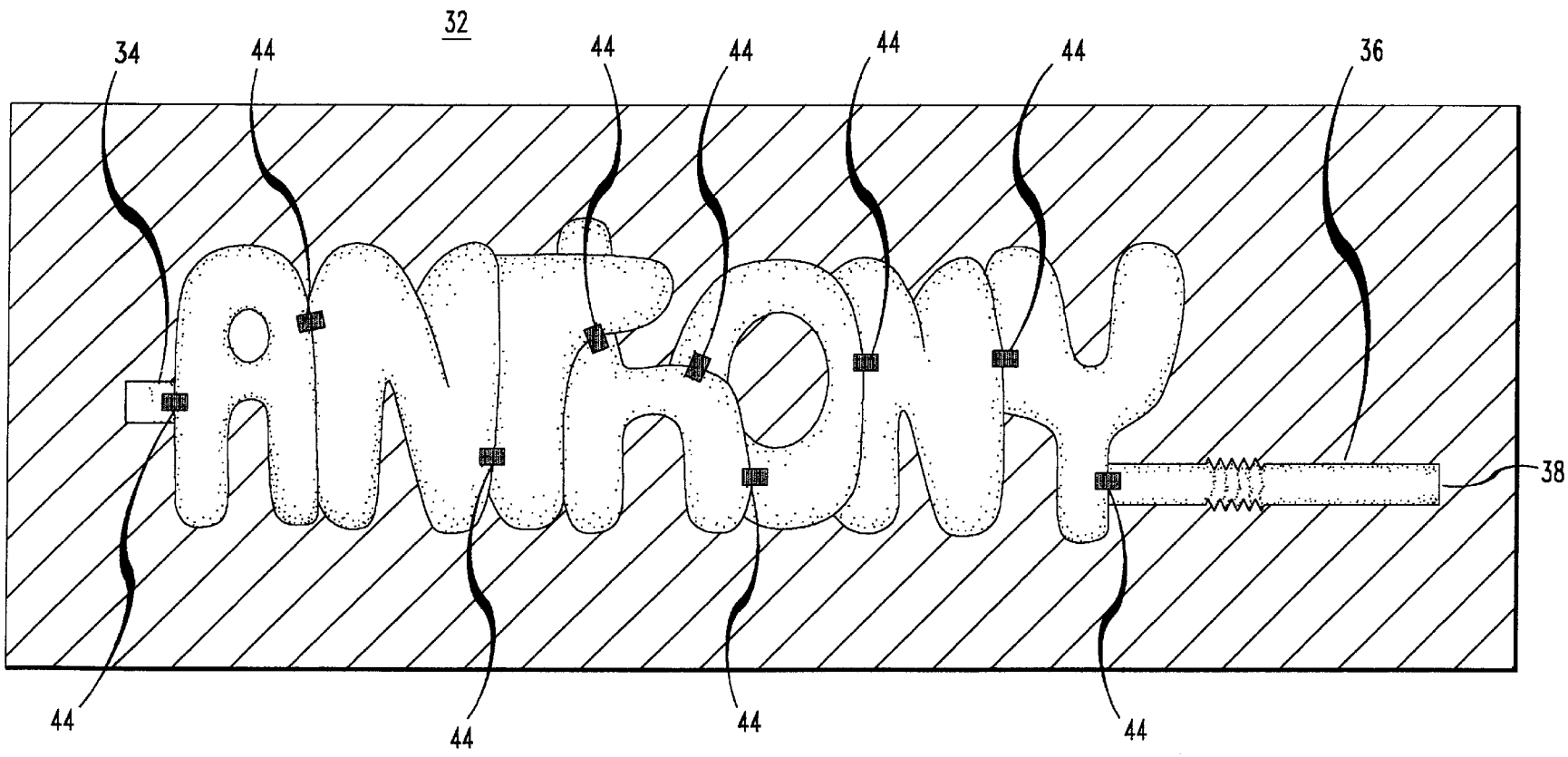
FIG. 2 illustrates a manner of injection molding the personalized name component, and a manner of channeling liquid from a first letter of the name through and into the last letter of the name.

In FIGS. 1 and 2, three interchangeable, generally tubular straight components 10, 12, 14 are shown, typically of a ¼ inch outer diameter and each with a surrounding coupler 16 at an end thereof. Such coupler 16 may have an inner diameter of such ¼ inch dimension, and an overall length from end-to-end of ⅜ inch. In one embodiment of the invention, the straight component 10 was selected of 4 inch length, with the components 12 and 14 being of equal 3 inch lengths. As will be appreciated, two, or any combination of these three components 10, 12, 14 can be detachably secured together by means of the couplers 16 to vary the amount by which the drinking straw of the invention will extend out from a liquid retaining container, such as a glass 18. As shown in FIG. 1, only one straight component, 10, is there depicted in illustrating the construction of the desired configuration wanted for the personalized name straw.

FIG. 1 further shows three loop components 20, 22, 24, all preferably generally tubular, of ¼ inch outer diameter, and each with its own associated coupler 26—like the coupler 16, being of a ¼ inch inner diameter and of a ⅜ inch length. Such loop components 20, 22, 24, as with the straight components 10, 12, 14, preferably are of a rigid plastic composition, with the couplers 16 and 26 being preferably of a pliable plastic composition. In this embodiment of the invention, furthermore, such straight components and such loop components are individually colored, of a transparent see-through composition, although the "coloring" and the "transparency" can be done-away with, if desired. As will be appreciated, any of the loop components 20, 22 or 24 can be detachably secured to each other and/or to any of the straight components 10, 12, 14, by means of the coupler 26, on the one hand, or the coupler 16, on the other hand, to form the desired configuration selected for the drinking straw shape. In similar manner, the dimensions selected for these components 10, 12, 14 and 20, 22, 24 can be selected as desired, and still carry out the teachings of the invention. Thus, with the loops 20 and 22, an effective length from end-to-end could be made to equal the same 4 inch length typifying the straight component 10, while the effective length from end-to-end for the loop 24 can be made to equal the 3 inch length typifying the straight components 12 and 14.

The personalized name straw of the invention further includes, in this embodiment, one right-angle component 28—also generally tubular (and of a rigid plastic composition as with the components 10, 12, 14 and 20, 22, 24) and of ¼ inch outer diameter, with its own associated pliable coupler 30—like the couplers 16 and 26, having an inside diameter of ¼ inch and an overall length of ⅜ inch. In similar fashion, although not necessarily so, the right-angle, or elbow, component 28 may be of a colored, transparent plastic composition. Such component 28 is shown in FIG. 1 as connecting to the straight component 10 in forming one type of straw configuration embodying the invention.

FIGS. 1 and 2 illustrate the personalized name component 32. As FIG. 1 and 2 show, the name component 32 includes a first straight-leg portion 34 arranged to detachably secure with one of the straight, loop, or right-angle elbow components by means of their couplers 16, 26 or 30, respectively. As FIGS. 1 and 2 further illustrate, the personalized name component 32 also includes a second, straight-leg portion 36 in forming the sipping section of the straw, as at 38. Shown as consisting of a series of letters making up the personalized name component 32, such component 32 includes a plurality of hollowed-out letters connected one to another, to channel liquid from the first straight-leg portion 34 through the various letters 40 through to the second straight-leg portion 36, and from there out through the sipping section 38. As with the other described components, the individual letters 40 of the personalized name component 32 may be of a rigid plastic composition, transparent and colored. As the arrows 42 of FIG. 1 identify, the liquid flow created by the sipping action of a user is through, and around each letter 40 of the name component 32, to create the desired configuration and shape for the drinking straw fitted together by the user.

As FIG. 2 further illustrates, the personalized name component 32 according to this embodiment, includes a plurality of individualized spacers 44 which funnel the liquid flow from the straight-leg portion 34, through the various hollow letters 40, and out through the straight-leg portion 36. As will be apparent to those skilled in the art, such name component can be fabricated by injection molding, with the individual spacers 44 effectively forming apertures between each of the letters 40 to allow the liquid flow through the component 32. In this construction of the invention, the personalized name component 32 also may be of some 3 to 4 inches in length.

Figure 3:
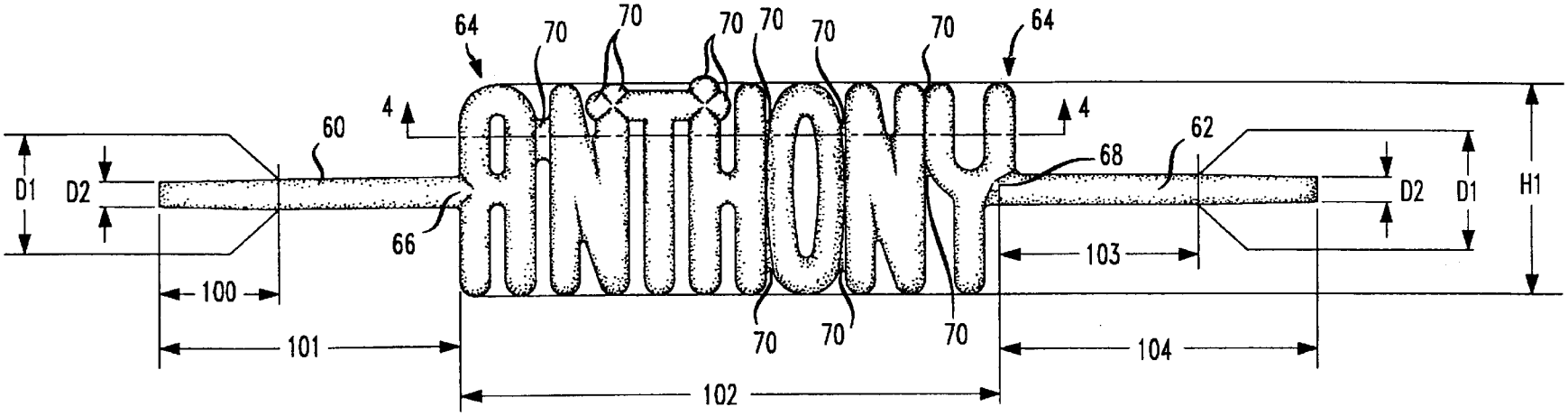
FIG. 3 shows a personalized name straw constructed in accordance with a preferred embodiment of the invention.
Figure 4:
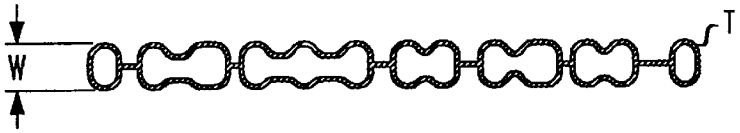
FIG. 4 is a sectional view helpful in an understanding of the illustration of FIG. 3.

The preferred embodiment of the invention is, on the other hand, shown in FIGS. 3 and 4, which eliminate the need for various ones of straight, loop and right-angle components for shaping the straw for use. A rigid plastic composition, of clear see-through material is depicted, and fabricated of first, second and third components which may be individually colored, either differently or similarly. Shown as being co-linear, the first component shown as 60 is of generally tubular configuration and is duplicated as the third component 62, the difference between them being that the first component 60 is coupled into the first letter of the user's name, while the third component 62 couples into the last letter of the name. Such "name" is shown as the second component 64, having individual apertures 66, 68 which couple the first and last letters of the name to the respective first and third components 60, 62. A plurality of spacers 70 interconnect openings within the individual letters of the name, at a point substantially where each of the abutting letters touch, in forming a conduit in permitting a liquid flow either from left-to-right or from right-to-left in FIG. 3, allowing sipped liquid to flow from one end to the other (as from component 60 to component 62, or from component 62 to component 60) through the user's name. In this respect, FIG. 4 will be understood to be a view of the second component 64, taken along the sectional line 4—4. In such manner, the first component 60 may be arranged for sipping by the user, while the third component 62 is arranged for placement into the liquid retaining container. In such usage, the liquid flow proceeds into the letter "Y", and from there through its abutting, adjacent letters to exit at the first letter "A". In an alternative use, as will be apparent, the third component 62 may be arranged for sipping by the user, with the first component 60 being arranged for placement into the container—in which case, the liquid flow from the container is through the component 60, into the first letter "A", and from there through its abutting, adjacent letters, to exit at the last letter "Y".

In preferred usage of the embodiment of FIGS. 3 and 4, the first and third components 60, 62 are selected to have a given diameter $D_1$, which is many times less than the height of the letters, shown as $H_1$. In this construction, $H_1$ is selected, however, of a length so as to enable all the letters of the personalized name to fit between the inner walls of the liquid retaining container, so that the end of the first or third component being placed into that container can extend completely to its bottom surface. To accommodate those instances where the liquid retaining container is very tall, the first and third components 60, 62 can be constructed so as to taper outwardly from the point where it joins the opening in the letters to a reduced diameter $D_2$ at their ends, where a conventional sipping straw can then be fitted over and around the ends of the components 60, 62, in effect serving as an extension thereof.

While Applicant does not wish to be limited to any particular set of dimensions, the following have proved useful with the preferred embodiment of FIGS. 3 and 4, where the notations W and T represent the "width" of the individual letters of the second component 64 and the nominal thickness of the walls of individual letters, respectively:

| | |
|---|---|
| Diameter $D_1$ | 0.25 inch |
| Diameter $D_2$ | 0.22 inch |
| Height $H_1$ | 1.75 inch |
| Width W | 0.35 inch |
| Thickness T | 0.04 inch |
| Dimension 100 | 1.0 inch |
| Dimension 101 | 2.50 inch |
| Dimension 102 | 4.50 inch |
| Dimension 103 | 1.50 inch |
| Dimension 104 | 2.50 inch |

In this respect, high-density polyethylene material was found particularly suited in fabricating the personalized name straw of this embodiment.

While there have been described what are considered to be preferred embodiments of the present invention, it will be readily appreciated that modifications can be made without departing from the scope of the teachings herein, of providing a take-apart, reconnectible personalized name straw, of any desired shape or configuration. As such, one can purchase such a straw according to the toddler or child's own name, and in allowing the child to then interconnect the individual components together in accordance with one embodiment of this invention to form the overall shape of the straw which is desired. Whether a series of straight components are coupled together, or intercoupled with loop components to correlate with the size of the liquid retaining container or not, the end result will be seen to be this fanciful design, personalized with the name of the user, and with the liquid flow being preferably a see-through colored liquid flow from the bottom depths of the container 18 through to the straight-leg portion 36 in any manner desired. Such "squiggly" liquid flow possible with the straw of the invention will be seen to be quite attractive to toddlers and children of all ages.

With the second embodiment of the invention, on the other hand, it will be apparent that with its personalized name-straw components forming the letters of the user's name, liquid flow can result from the first letter of the name through the adjacent letters and into the last letter of the name, or vice-versa, depending on the manner of coupling, and easily following by having the components co-linear. Such added feature not only allows a liquid flow as from "A" through to "Y", or from "Y" through to "A" as in FIG. 3, but also permits the personalized portion to be aligned "upside-down" for example in permitting the liquid flow through the letters inverted—giving yet alternative features pleasurable to children.

For at least such reasons, therefore, resort should be had to the claims appended hereto for a true understanding of the scope of the invention.

I claim:

1. A personalized name straw comprising:

first, second and third intercoupled components forming a drinking straw of desired configuration:

with said second component being in the nature of a name personalized to a user and having a conduit therein to channel liquid from one end thereof to an opposite end thereof;

with one of said first and said third components being of generally tubular configuration arrangeable for placement into a liquid retaining container for the sipping of liquid therethrough;

and wherein said second component includes a plurality of letters abutting one another in forming the name of said user, with a plurality of interconnecting spacers between openings in the adjacent letters thereof at a point substantially where each of said abutting letters touch;

and wherein said first, said second and said third components are colinearly intercoupled for channeling liquid through said other of said first and said third components into the last letter of the user's name, through said interconnecting spacers and through said adjacent letters into the first letter of the user's name, and from there through said one of said first and said third components into the user's mouth;

and wherein said first, said second and said third intercoupled components are colinearly coupled for alternatively channeling liquid through said one of said first and said third components into the first letter of the user's name, through said interconnecting spacers and through said adjacent letters into the last letter of the user's name, and from there through said other of said first and said third components into the user's mouth;

wherein said abutting adjacent letters of said second component are of a height $H_1$ several times greater than said diameter $D_1$, and wherein said first and said third components are of a given diameter $D_1$, and wherein said first and second third components taper away from said intercoupled second component to a diameter $D_2$, slightly less than said diameter $D_1$.

2. The combination of claim 1, wherein said first, second and third components are of a rigid plastic composition.

3. The combination of claim 1, wherein said first, second and third components are of a clear see-through composition.

4. The combination of claim 3, wherein said first, second and third components are individually colored.

5. The combination of claim 3, wherein said first, second and third components are of the same individual coloration.

6. The combination of claim 3, wherein said first, second and third components are fabricated of a high density polyethylene material.

* * * * *